US005351342A

United States Patent [19]

Garneau

[11] Patent Number: 5,351,342

[45] Date of Patent: Oct. 4, 1994

[54] PROTECTIVE HEADGEAR

[76] Inventor: Louis Garneau, 246, Chemin de la Butte, Saint-Augustin-de-Desmaures, Québec, Canada, G3A 2E6

[21] Appl. No.: 42,656

[22] Filed: Apr. 5, 1993

Related U.S. Application Data

[63] Continuation-in-part of Ser. No. 829,287, Feb. 3, 1992.

[51] Int. Cl.[5] ..... A42B 3/02

[52] U.S. Cl. ..... 2/414; 2/425; 2/DIG. 1

[58] Field of Search ..... 2/414, 411, 412, 424, 2/425, 410, DIG. 1

[56] References Cited

U.S. PATENT DOCUMENTS

| | | | |
|---|---|---|---|
| 3,116,490 | 1/1964 | Zbikowski | 2/414 |
| 3,935,044 | 1/1976 | Daly . | |
| 4,051,555 | 10/1977 | Daly | 2/412 |
| 4,133,055 | 9/1979 | Zebuhr | 2/411 |
| 4,619,003 | 10/1986 | Asbury | 2/412 X |
| 4,656,667 | 4/1987 | Blake | 2/412 X |
| 4,710,984 | 12/1987 | Asper et al. | 2/412 |
| 4,736,469 | 12/1988 | Boretti | 2/411 |
| 4,796,309 | 10/1989 | Nava | 2/414 |
| 4,845,786 | 7/1989 | Chiarella | 2/425 X |
| 4,901,373 | 2/1990 | Broersma . | |
| 4,996,724 | 5/1991 | Dextrase | 2/411 |
| 5,119,516 | 6/1992 | Broersma | 2/411 |

FOREIGN PATENT DOCUMENTS

| | | | |
|---|---|---|---|
| 718684 | 9/1965 | Canada . | |
| 868101 | 4/1971 | Canada . | |
| 1200052 | 2/1986 | Canada . | |
| 0096148 | 12/1983 | European Pat. Off. | 2/411 |
| 0391389 | 10/1990 | European Pat. Off. . | |
| 2901088 | 7/1980 | Fed. Rep. of Germany . | |
| 8120605 | 11/1981 | Fed. Rep. of Germany . | |
| 2473855 | 7/1981 | France . | |
| 9105488 | 5/1991 | PCT Int'l Appl. . | |

*Primary Examiner*—Peter Nerbun

*Attorney, Agent, or Firm*—Pierre Lespérance; François Martineau

[57] ABSTRACT

A safety helmet comprises hard internal and external shells and a shock-absorbent insert. The internal shell forms at its lower edge and on the outside thereof an upwardly-opening trough in which the insert is inserted. The free edge of the trough joins with the lower edge of the external shell above the bottom of the trough. The two shells, together with the insert, form ventilation openings which are lined by portions of the two shells. The main portion of the internal shell is embedded into the soft-bodied insert, so that it is mainly the insert that contacts the wearer's head, but for the rim portion thereof where the internal shell still surrounds the bottom edge of the insert.

6 Claims, 3 Drawing Sheets

PROTECTIVE HEADGEAR

CROSS-REFERENCE DATA

This patent application is a continuation-in-part of Applicant's copending parent application Ser. No. 07/829,287 filed 3 Feb. 1992. An election of species was requested in said parent application, hence the present divisional application. Moreover, this application includes additional subject matter (manufacturing process) not present in said parent application.

FIELD OF THE INVENTION

The present invention relates to safety or protective helmets for cyclists heads.

BACKGROUND OF THE INVENTION

Co-pending parent application Ser. No. 07/829,287 is hereby incorporated by way of reference to the present patent application.

Conventional safety helmets comprise an impact resistant, hard external shell and an inner shock-absorbent liner which is contoured to fit and protect the head of the wearer. Usually, the shock-absorbent portion of the helmet is made of a low-density soft material, such as expanded polystyrene foam, which is easily damaged and soiled during handling.

U.S. Pat. No. 4,996,724 dated Mar. 5, 1991 and entitled: PROTECTIVE RIM CONFIGURATION FOR HARD SHELL SAFETY HELMET - inventor: Serge Dextrase, partially overcomes the above-noted disadvantage, by providing a rim configuration made of the same hard material as the external shell and covering the lower periphery of the external shell. However, in such a helmet, the polystyrene foam is still left exposed inside the helmet.

In order to have sufficient impact resistance, the liner of such a helmet must be relatively thick or the foam material of said liner must have a relatively high density, for instance at least 6 pounds per cubic foot.

Another problem with existing safety helmets is that, once they have sustained a first major blow, they tend to fracture, become fragmented and to fall apart—the fragmented parts thereof release one another—. This is to say, the helmet disintegrates. This is unfortunate, since in high-speed cycling accidents, multiple ground impacts of the head are not uncommon. If the helmet has already fragmented and disintegrated after the first ground impact, it becomes useless in preventing head injuries for the following ground impacts of the behelmeted cyclist.

OBJECTS OF THE INVENTION

It is the general object of the present invention to provide a safety helmet of the character described, which is provided with an internal shell as well as an external shell, the internal shell being made of hard material and substantially covering the inner surface of the shock-absorbent liner.

Another object of the present invention is to provide a safety helmet of the character described, in which all the surfaces of the shock-absorbent liner, including those at the ventilation openings, are covered and coated by the hard internal and external shells.

Another object of the present invention is to provide a safety helmet of the character described, of minimum weight and yet of maximum resistance to impact.

An important object of the invention is to provide an alternate embodiment of such helmet, having means to capture and retain to the helmet fragments of impacted parts thereof, wherein a major portion of the internal shell is embedded into the soft-bodied insert part of the helmet.

SUMMARY OF THE INVENTION

The safety helmet of the invention is especially designed for cyclists and comprises a safety helmet for use with chin retention straps on a cyclist's head, comprising: (a) a hard, resiliently flexible, external shell; (b) a hard, resiliently flexible, internal shell, defining a main portion and a rim portion, the latter rim portion formed by an outwardly extending web and a flange projecting upwardly externally from said web, the latter rim portion thus constituting an upwardly-opening trough; and (c) a soft, substantially rigid, shock absorbing insert, also defining a main portion and a rim portion, said insert main portion defining an external surface generally conforming with and adapted to fit onto the top of said cyclist head; wherein said insert rim portion conforms with and adheres to the outer surface of said internal shell rim portion, and fills said trough; said internal shell main portion is embedded into said insert main portion; said internal shell rim portion surroundingly conforming with and adapted to fit around the sides of said cyclist head; said insert rim portion having an external surface, substantially flush with said flange; said external shell conforming with and adhering to the external surface of said insert and having a bottom edge forming a joint with the top edge of said flange; and further including ventilation openings, each extending through said internal shell, insert and external shell.

Preferably, said internal shell is substantially thinner relative to said external shell, and its flexibility, accordingly greater.

Advantageously, a generally annular marginal portion is defined between said rim portion and main portion of said internal shell, said marginal portion being flush with the adjacent areas of said insert main portion so that the whole internal face defined by said helmet be smooth, for comfort of said cyclist.

Profitably, said joint is a lap joint. Moreover, it is envisioned that said external and internal shells form tube-like extensions, surrounding their respective portions of said ventilation openings and protruding inwardly of said external shell and outwardly of said internal shell, respectively, the extensions of the external shell butting the extensions of the internal shell, said extensions forming a liner coating the surfaces of the insert which would otherwise be exposed in said ventilation openings.

Preferably, said internal shell main portion further includes a number of transverse fingers spaced from one another, at least some of said fingers extending toward the inner face of said insert main portion and therethrough, so that the free end defined by each of said at least some of said fingers comes substantially flush with said insert main portion inner face.

DETAILED DESCRIPTION OF PREFERRED EMBODIMENTS

Figure 1:
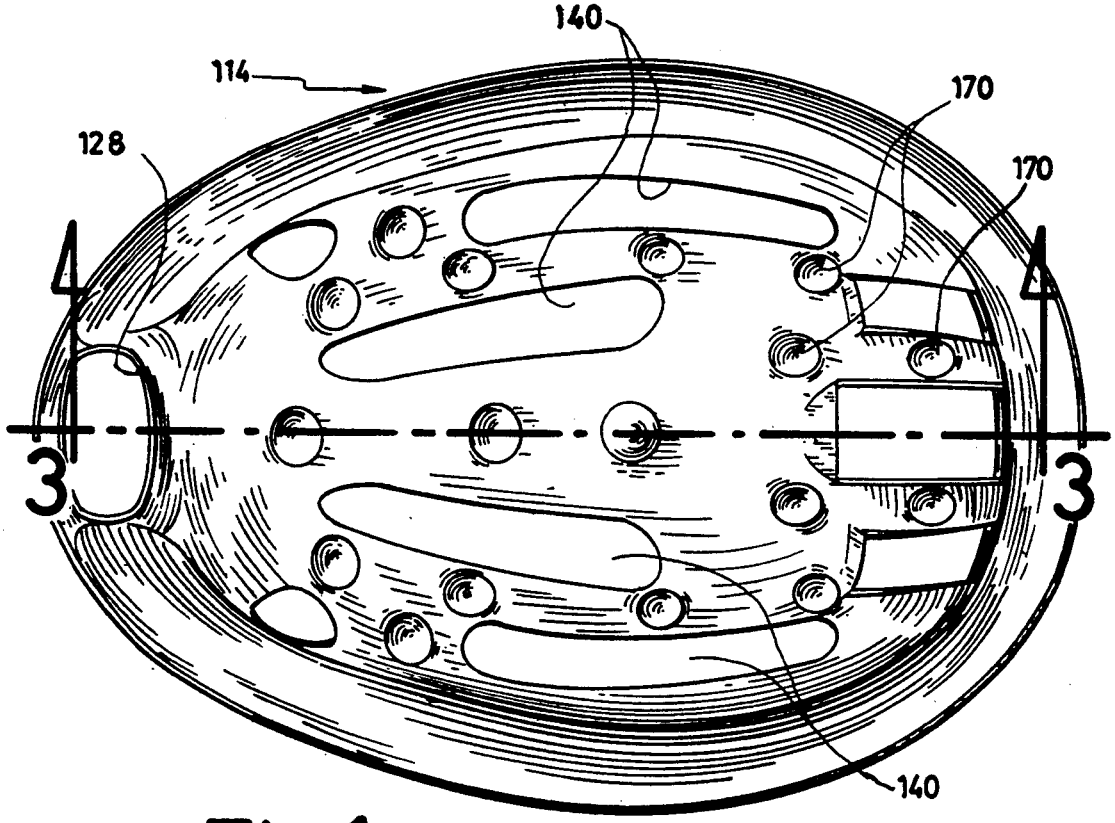
FIG. 1 is a top plan view of the preferred embodiment of the helmet internal shell part.

In the co-pending parent patent application Ser. No. 07/829,287 filed 3 Feb. 1992, the protective headgear, or more commonly named safety helmet, was said to comprise an external shell, an internal shell, and a shock-absorbing insert. Both shells are made of hard yet resiliently flexible material, such as ABS, or similar thermoplastic material- Preferably, each shell has a thickness of about 0.3 millimeters. The insert is made of light weight, soft yet substantially rigid, shock-absorbing material, preferably expanded polystyrene foam. The insert preferably has a non-uniform thickness averaging about 30 millimeters. Instead of the usual density of 6 pounds per cubic foot, found in the foam portions of prior art safety helmets, the helmet of this co-pending application has been provided with the insert having a density of only 3.5 pounds per cubic foot.

Such a lower density helmet insert has recently been certified (in August 1991) by the Snell Memorial Foundation, inc. (St. James, N.Y.) as having demonstrated compliance with the performance requirements under the B-90 standard for protective headgear. It therefore meets safety standards for cyclists, even though its density is almost half that of conventional helmet inserts.

From this, it is clear that, providing a full internal shell considerably increases the helmet resistance to impact. Therefore, providing an internal shell, which covers the wearer's head, provides a structural function for the helmet in that it has a synergistic effect with the external shell and insert.

The internal shell is provided at its lower periphery with a bottom rim portion, formed by an outwardly-extending web and a flange projecting upwardly from the web. Thus, the rim portion forms an upwardly-opening trough surrounding internal shell and which is completely filled by the bottom portion of the insert. The external shell terminates downwardly short of the bottom portion of the insert, and its lower edge forms a joint with the top edge of the flange.

In this co-pending application, the joint is preferably a lap joint, but can be a butt joint. In both cases, the joint is preferably covered, for aesthetic purposes, by a strip 126 adhered to the flange and to the adjacent portion of the external shell. Strip 126 completely surrounds the helmet.

The internal shell conforms with, and is adapted to cover, the wearer's head, including part of the forehead and the back of the head just above the neck.

Still in this co-pending application, the rear section of the rim portion and the corresponding part of the insert is thicker than the front section of rim portion and corresponding part of the insert. The rear section of the rim portion is provided with a central orifice defined by an upwardly-extending tubular extension, at the top of which is exposed the insert. The orifice, with its tubular extension, is formed in an upwardly-recessed central section of the rim portion.

Elongated cushioning patches are adhered to the inside surface of the internal shell and are adapted to contact the wearer's head while maintaining the internal shell spaced from said head. Each patch includes velours or terry-like fabric.

To further reinforce the helmet, the external shell is provided with a pair of longitudinally-extending ribs, which protrude inwardly from the inner surface of the external shell, thereby forming grooves at the outer surface of the latter. Similarly, the internal shell is provided with a pair of longitudinal grooves, which protrude outwardly from the external surface of the internal shell toward external shell. The ribs are longitudinally registering and are preferably diverging from back to front of the helmet.

In this co-pending application, ventilation openings are formed through the helmet, more specifically through the external shell, the insert, and the internal shell. Ventilation openings are located through the ribs, while ventilating openings are disposed along the central plane of the helmet, and also forwardly of the ribs. Obviously, additional ventilation openings could be provided. These ventilation openings are characterized by the fact that their portions formed in the internal shell and external shell are surrounded by tubular extensions, respectively. The extensions inwardly protrude from the external shell, while the extensions outwardly protrude from the internal shell. The two extensions abut against each other approximately mid-way of the thickness of the insert to form a butt joint. Thus, the tubular extensions completely line the surfaces of the insert which would otherwise be exposed in the ventilation openings.

The helmet is provided with retention straps 152, 152*a* of known construction, and including length-adjusters and chin straps. At the back of the helmet, the retaining strap extends through a portion of two transversely-aligned ventilation openings 140 underneath the external shell through a passage formed by a transverse groove, made at the outer surface of the insert, and communicating with the two ventilation openings. Similarly, a pair of transversely-spaced strap-receiving orifices 160 are formed at the front of the helmet for the passage of the retaining strap. The two orifices communicate with a transverse passage formed by a groove at the outer surface of the insert.

The internal and external shells are separately molded; the internal shell is inserted in a mold in which is injected the material of the insert, the polystyrene then expanding within the mold to its final shape and adhering to the outer surface of the hot internal shell. The resulting assembly, once cured, is covered with the external shell which is adhered to the insert after the positioning of the retaining straps. The patches are finally positioned on the internal shell. The resulting helmet is very light; it has a minimum of thickness and fully complies with the regulations governing the resistance to impact of such helmets.

Figure 3:
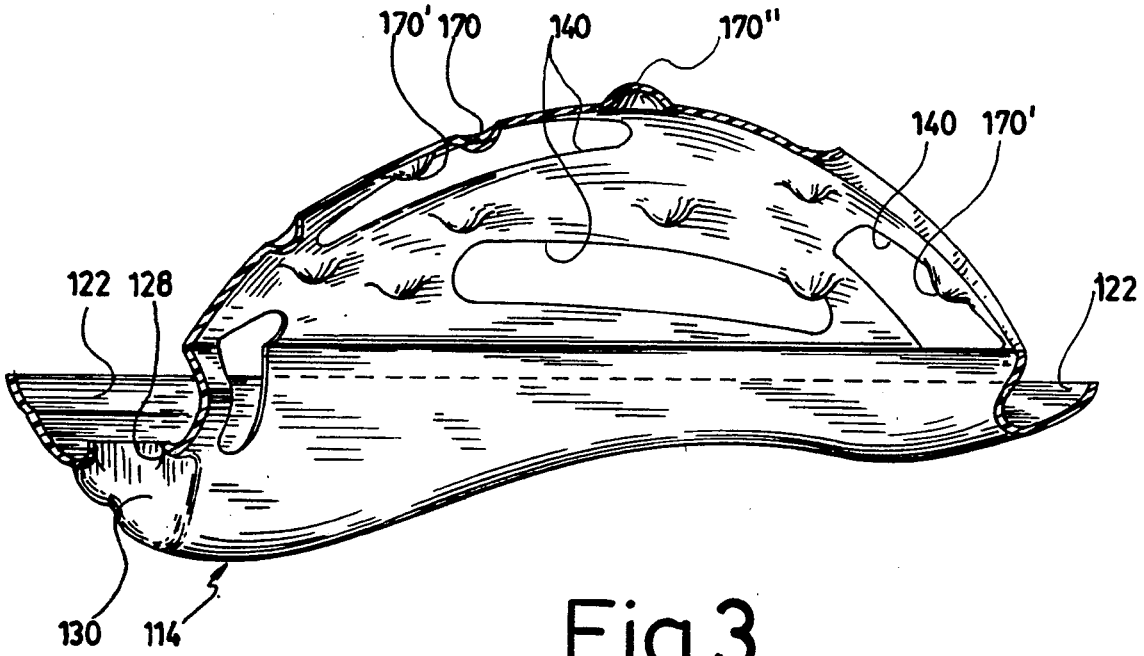
FIGS. 3 and 4 are sectional views of the internal shell taken along lines 3—3 and 4—4 respectively of FIGS. 1 and 2.
Figure 3A:
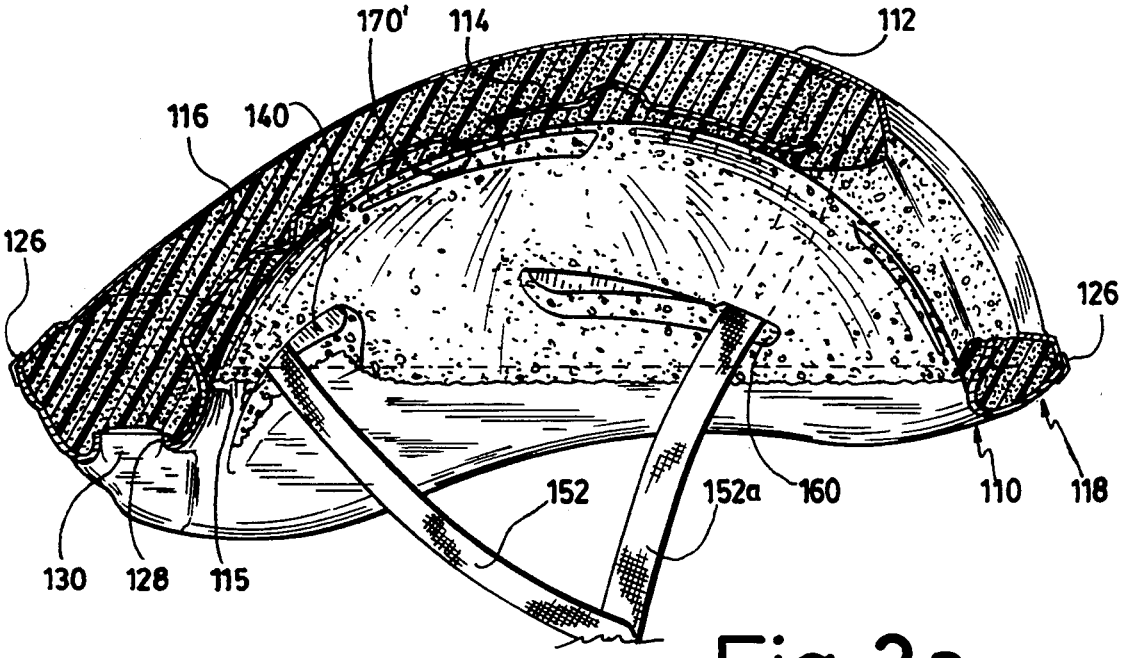
FIGS. 3*a* and 4*a* are views similar to FIGS. 3 and 4 respectively, but showing the helmet in full including the insert and the external shell thereof.
Figure 4A:
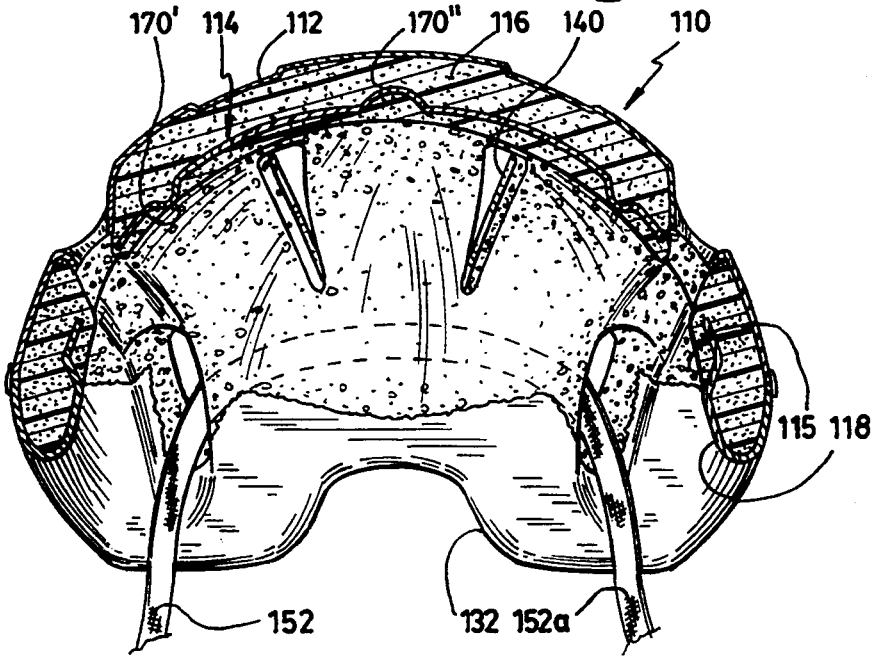

Now, according to the present preferred embodiment of the invention, there is provided a helmet as illustrated at 110 in FIGS. 3*a* and 4*a*. Internal shell 114 is made of a hard yet resiliently flexible material. Preferably, shell 114 could have a thickness, e.g. 0,1 mm. Moreover, shell 114 has preferably a large number of ventilation openings 140 formed therethrough.

Still another novel feature of the present internal shells is in the way the internal shell 114 is mounted to the insert 116. Indeed, as best seen in FIGS. 3*a* and 4*a*, the main portion of shell 114 is embedded into insert 116, while the rim portion 118 of shell 114 is not—rim portion 118 forms an upwardly opening trough completely filled by the bottom edgewise portion of the insert 116. Thus, the main, generally concave wall of internal shell 114 is concealed within the thickness of the insert 116, so that it is the inner wall of insert 116, and not the internal shell 114, that will come in contact with the top portion of the cyclist's head—except at the rim portion where internal shell portion 118 will project outwardly from the thickness of the insert 116 to engage around the side portions of the wearer's head in the known fashion.

A marginal annular portion 115 is thus defined on the inside face of the helmet 110, adjacent the rim portion 118, where the internal shell 114 transversely engages through the soft body of the insert 116 to become embedded therein. Preferably, this marginal portion 115 will come flush with the internal wall of the insert 16, so as to define a smooth, non-irritating, inner surface joint for comfort of the wearer.

Thus, the helmet still retains two hard shells 112, 114 and one shock absorbing insert, 116 (as in said co-pending patent application). However, while in this co-pending application, all of the inner (concave) face of the helmet was lined with the internal shell 14, in the present invention 110, only the marginal rim portion 118 of the helmet is lined by the internal shell 114 while the major portion of its inner face is lined by the insert proper 116. The advantage of having the internal shell 114 partially embedded into the soft bodied, yet substantially rigid insert 116, is in the impact absorbing capabilities of the helmet 110. Indeed, with the present embodiment of helmet 110, what will be enhanced is the capability of maintaining together a number of structural fragments of external shell 112 and/or internal shell 114 and/or insert 116, following impact fracturing of the helmet 110. Obviously, internal shell 114, which is embedded into the insert 116 (the latter covering the wearer's head), still provides a structural function for the helmet 110, in that it has a synergistic effect with the external shell 112 and insert 116, in providing very high impact resistance, as for the embodiment disclosed in said co-pending application.

Maintaining together these various fragments of helmet 110 after impact, even if in non-integral fashion, is critical in providing post-impact sustained protection to the head in view of eventual secondary ground impacts of the cyclist's head following the initial impact. Indeed, the purpose of the helmet is to prevent head injuries, which usually occur when the cyclist loses control of his vehicle and falls to the ground. If the helmet becomes shattered and disintegrates after the initial ground impact, it will not help prevent head injuries if the cyclist's head strikes the ground for a second or third time—which could occur of course when the cyclist speed is relatively high before fall.

Figure 2:
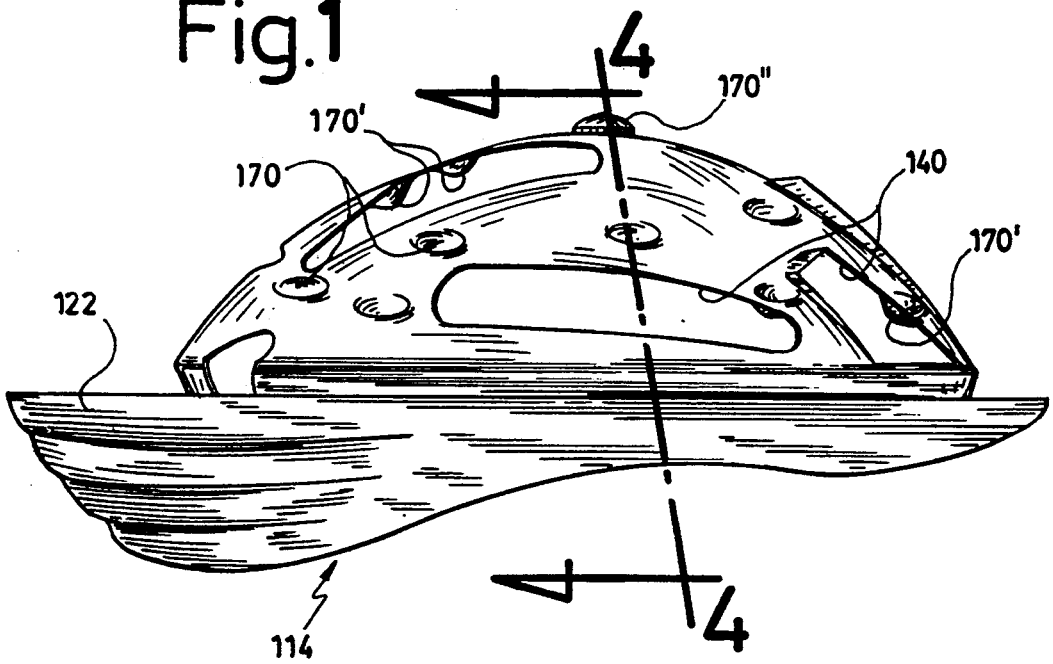
FIG. 2 is a side elevational view of the internal shell of FIG. 1.
Figure 4:
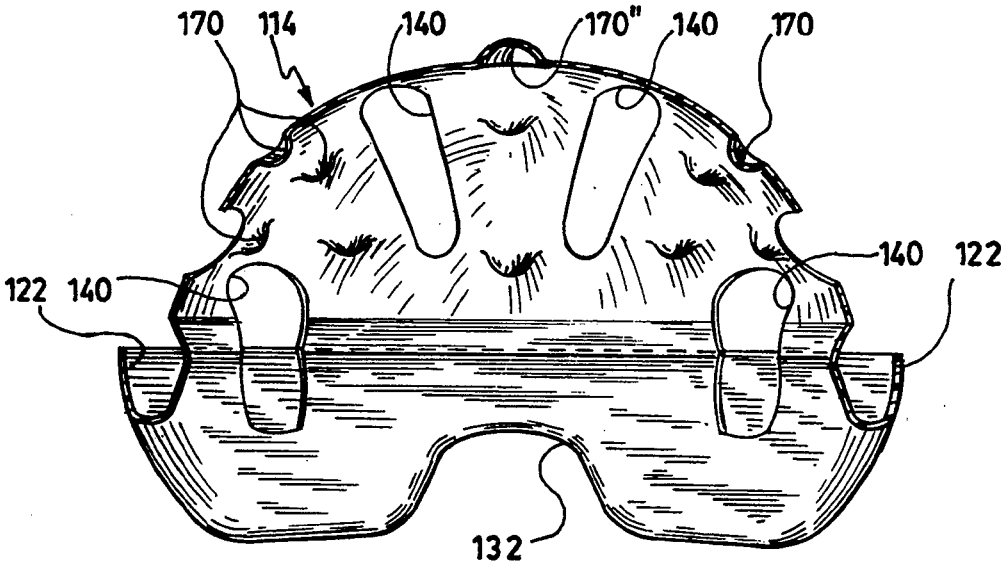

Preferably, and as best illustrated in FIG. 2, the outer face of the main concave wall portion of internal shell 114 is poked at a plurality of random locations, to define a plurality of inwardly projecting cavities 170. Such cavities 170 define on the internal face of the internal shell 114, full convex "fingers" 170' (the mirror image of the cavities 170). Cylindrical fingers 170' are destined to sink into the soft body of the insert 116 so as to more firmly anchor the shell 114 into the insert 116. The apex of the internal shell 114 preferably also includes an outturned cylindrical finger 170'' with a conical tip, extending in a direction opposite fingers 170', for the same purpose as the latter.

Preferably and as suggested in FIGS. 3*a* and 4*a*, the apices of outturned fingers 170' project through the inner face of the insert 116, so as to come flush with the inner face of insert 116. Hence, the inner face of soft-bodied insert 116 is dotted with a number of small discs 170' made of hard material and spaced from each other.

The invention also concerns a process for manufacturing such a helmet. The process includes the following steps:

(a) providing a first, dome-shaped ABS sheet shell, said first shell including a number of apertures therethrough joining inner and outer opposite convex faces defined by said dome-shaped shell;

(b) inserting said first shell into a female part of a male-female composite mould;

(c) closing a male part of said composite mould over said female part thereof, whereby said first shell becomes confined and enclosed into the enclosure defined within said composite mould;

(d) injecting expanded polystyrene granules into said composite mould enclosure, through said mould, whereby said granules cover at least a substantial portion of said first shell inner face and extends through said shell apertures to seep therethrough and cover at least a substantial portion of said first shell outer face;

(e) submitting said mould enclosure, for a period ranging between approximately 5 to 15 seconds, to the heating action of boiling water vapour, through a plurality of nozzles opening into said mould enclosure, wherein said expanded polystyrene granules will set into a dome-shaped cap and said first shell will become fixedly embedded thicknesswisely of said polystyrene cap;

(f) cooling said mould, for a period ranging between approximately 5 to 15 seconds, through the action of ambient temperature water sprays;

(g) stabilizing said integral first shell and polystyrene cap, for a period ranging between approximately 3 to 4 minutes;

(h) withdrawing said integral first shell and polystyrene cap from the mould enclosure;

(i) providing a second, dome-shaped ABS sheet shell; and (j) glueing a second, dome-shaped ABS shell against the inner dome-shaped face defined by said polystyrene cap, wherein said first and second shells becomes integral to one another via said polystyrene cap.

I claim:

1. A safety helmet for use with chin retention straps on a cyclist's head, comprising:

(a) a hard, resiliently flexible, external shell;

(b) a hard, resiliently flexible, internal shell, defining a main portion and a rim portion, the latter rim portion formed by an outwardly extending web and a flange projecting upwardly externally from said web, the latter rim portion thus constituting an upwardly-opening trough; and (c) a soft, substantially rigid, shock absorbing insert, also defining a main portion and a rim portion, said insert main portion defining an external surface generally conforming with and adapted to fit onto the top of said cyclist head;

wherein said insert rim portion conforms with and adheres to the outer surface of said internal shell rim portion, and fills said trough; said internal shell main portion is embedded into said insert main portion; said internal shell rim portion surroundingly conforming with and adapted to fit around the sides of said cyclist head; said insert rim portion having an external surface substantially flush with said flange; said external shell conforming with and adhering to the external surface of said insert and having a bottom edge forming a joint with the top edge of said flange; and further including ventilation openings, each extending through said internal shell, insert and external shell.

2. A safety helmet as in claim 1, wherein said internal shell is substantially thinner relative to said external shell, and its flexibility, accordingly greater.

3. A safety helmet as in claim 1, wherein a generally annular marginal portion is defined between said rim portion and main portion of said internal shell, said marginal portion being flush with the adjacent areas of said insert main portion so that the whole internal face defined by said helmet be smooth, for comfort of said cyclist.

4. A safety helmet as defined in claim 1, wherein said joint is a lap joint.

5. A safety helmet as defined in claim 1, wherein said external and internal shells form tube-like extensions, surrounding their respective portions of said ventilation openings and protruding inwardly of said external shell and outwardly of said internal shell, respectively, the extensions of the external shell butting the extensions of the internal shell, said extensions forming a liner coating the surfaces of the insert which would otherwise be exposed in said ventilation openings.

6. A safety helmet as in claim 1, with said internal shell main portion further including a number of transverse fingers spaced from one another, at least some of said fingers extending toward the inner face of said insert main portion and extending therethrough, so that the free end defined by each of said at least some of said fingers comes substantially flush with said insert main portion inner face.

* * * * *